United States Patent [19]

Sherman

[11] 3,998,456

[45] Dec. 21, 1976

[54] FOOTBALL TRAINING DEVICE

[76] Inventor: James T. Sherman, 2217 W. 19th St., Yuma, Ariz. 85364

[22] Filed: May 27, 1975

[21] Appl. No.: 580,563

[52] U.S. Cl. ..... 273/55 A
[51] Int. Cl.[2] ..... A63B 67/00
[58] Field of Search ..... 35/29 R; 273/55 R, 55 A; 272/76, 77, 78

[56] References Cited

UNITED STATES PATENTS

| | | | |
|---|---|---|---|
| 419,285 | 1/1890 | Sanborn | 272/76 |
| 931,818 | 8/1909 | Valentine | 272/76 |
| 2,162,073 | 6/1939 | Evans | 273/55 R |
| 2,620,188 | 12/1952 | Malagio | 273/55 A |
| 3,062,547 | 11/1962 | Kopp | 273/55 R |
| 3,427,021 | 2/1969 | Donato | 273/55 R X |
| 3,514,105 | 5/1970 | Pillard | 273/55 R |
| 3,804,410 | 4/1974 | Gilman | 273/55 R |
| 3,888,481 | 6/1975 | Adams | 272/76 X |

OTHER PUBLICATIONS

Henry T. Brown, "507 Mechanical Movements" Publ. by Brown & Seward Aug. 1901, Worm Gears pp. 20, 21.

*Primary Examiner*—Harland S. Skogquist
*Attorney, Agent, or Firm*—J. Michael McClanahan

[57] ABSTRACT

A football training device for training a defensive linesman player to block aside the offensive linesman in order to penetrate the offensive line and reach the ball carrier. The training device comprises a plurality of simulated offensive line players' helmets attached to spring means and arranged to present a choice such that the defensive linesman may rip to the left or the right to engage a plurality of simulated offensive linesman in a sequential order. The height and relative placement of the helmets may be varied by adjusting means connected to one end of said springs. Means are provided for a coach to stand in the center of the simulated offensive linesman training device and indicate to the defensive player which direction he is to rip.

7 Claims, 10 Drawing Figures

FOOTBALL TRAINING DEVICE

BACKGROUND OF THE INVENTION

It is customary in football training practice to present opposition to defensive linesman in the form of machines or devices simulating the opposing offensive line. The defensive linesman's primary purpose is to make his way through the offensive line seeking the ball carrier and either tackle the ball carrier or interfere with the ball carrier's attempt to pass the football. To this end devices have been made which present a static opposition to the defensive player such as a hard packed, sand or otherwise filled, canvas bag which the defensive player rushes and attempts to block out of the way with his shoulders or to run over the device.

Similarly there are devices consisting of static filled blocking dummies which may be sled mounted or spring mounted to permanent structures such that the defensive linesman can move the dummy only with a sufficiently large applied force.

It is presently popular for defensive football players to employ the so called "rip up" movement of their arm to move aside a blocking offensive linesman in order to maneuver their way past the offensive linesman and make contact with the ball carrier, or to be in position to block an attempted football pass. To accomplish this rip-up movement, the defensive player, moving from a two, three, or four point stance (two feet on the ground, two feet plus one hand touching the ground, or two feet plus both arms touching the ground), raises his arm up and across his body, the arm being bent at an approximate 90° angle at the elbow. If the defensive player wishes to oppose an offensive player to his left, the defensive player raises his right arm to perform the rip-up movement. The player's first movement is to bring his arm (palm towards his body) to catch his opponent's helmet at the top of his arm, permitting the opponent's helmet to catch in the acute angle formed by his arm and forearm, and turn the opponent player's head away from the hole that the defensive player in attempting to create in the offensive line. While one arm is performing the rip-up movement, the other arm is out to the side helping the defensive player maintain his balance and to ward off any other players. Then with a short, quick step, the defensive player steps past his opponent player and into the hole that has been created by turning the offensive player away. The rip-up movement described is accomplished for two purposes, one is described above and two, as a protective measure to prevent the opposition player upon whom the movement was performed, from blocking the defensive player at his knee level.

The defensive player recovers after bringing his arm up and across to a two-point stance, low to the ground, and ready, if necessary, to perform the same rip-up movement operation upon an offensive linesman who perhaps has noticed his fellow player's situation and attempts to block the defensive linesman's rush through the line. The defensive linesman then may again continue with the second rip-up movement, utilizing the appropriate arm. Naturally, the offensive players do resist the rip-up movement by attempting to extricate their helmet from the defensive player's grasp.

SUMMARY OF THE INVENTION

The present invention provides a skill and reaction mechanism for the purpose of training the defensive football players in the rip-up movement of either arm. To that end, the offensive football player's helmets are simulated to provide resistance to the defensive player's rip-up movement.

The present invention comprises a plurality of football helmets spring mounted on both sides of a land-based, V-shaped support. Normally, equal number of helmets are on each side of the apex of the V-support. The invention provides means for adjusting the height of the helmet above the ground and means for adjusting the relative distance between helmets.

Attached to the V-shaped land support are upright standards which additionally have attached at their end opposite the land-based standard, either a fixed or rotatable arm to which is attached the spring aforementioned. On the other, opposite end of the spring is operably connected the helmet. The spring is selected to provide the desired resistance to movement by the defensive player when simulating the offensive player's head and helmet.

Further, to adapt the subject invention to a wider area of use, the upright standards are attached to fastening means which permit the position of the upright standard to be adjusted along the land base standard.

In normal operation, the defensive linesman takes a two, three, or four-point stance in front of the apex of the V-shaped support or land-based standard. Upon direction by the coach, standing at the apex of the V and motioning with his hands which direction the player is to move, the coach initiates the player's movement and the direction of such movement. Additionally, means may be provided for a trolley-mounted display, the coach can indicate by a visible marking, when and in which direction to proceed. Upon signal from the coach, the player moves in the appropriate direction seizing the first helmet and performs the rip-up movement, the spring mounted helmet provides suitable resistance to the player's movement. Moving the first helmet aside, the player then proceeds to the second helmet in line and accomplishes the same rip-up movement. Upon completing the second rip-up movement, the player moves off and the next player in line takes his position interior to the angle formed by the V-shaped support.

Accordingly, it is an object of the present invention to provide a football training device for defensive players to practice the rip-up movement against a plurality of simulated offensive players.

DETAILED DESCRIPTION

Figure 1:
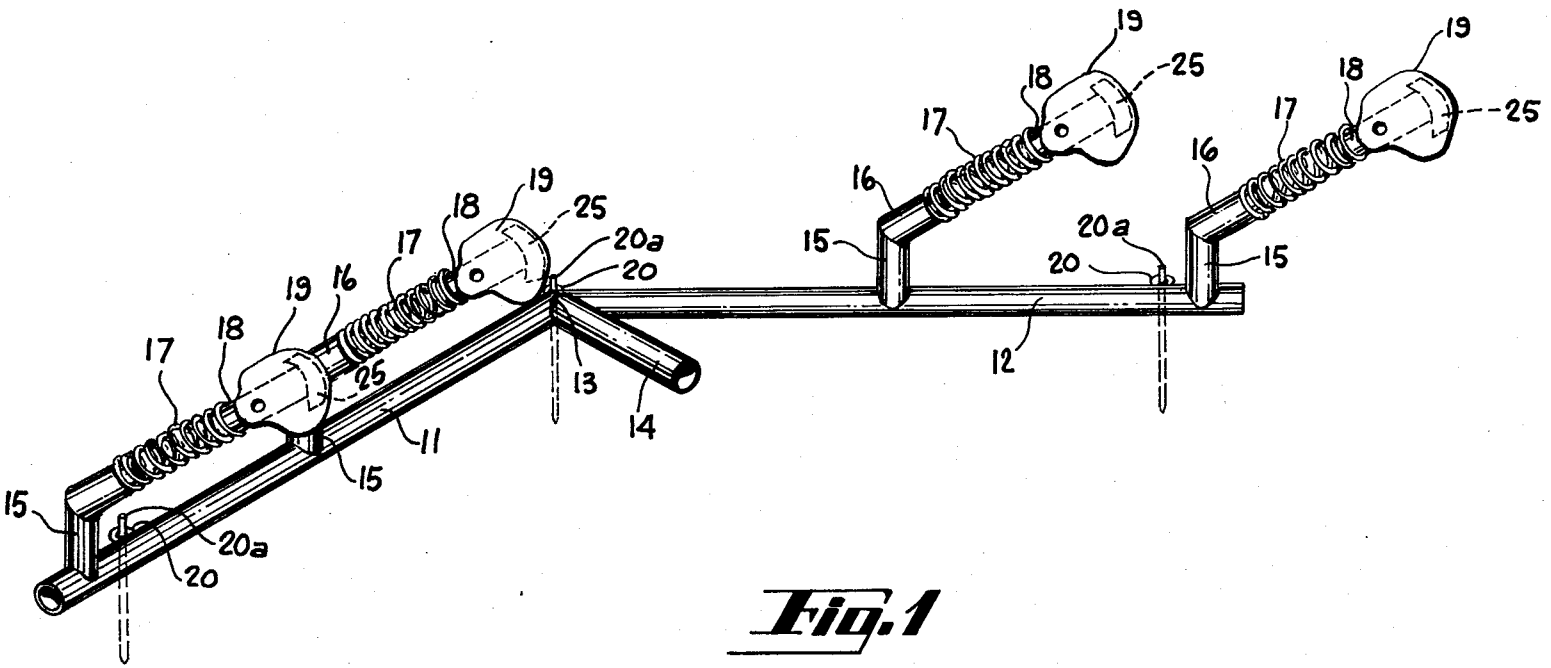
FIG. 1 is a perspective front view of the subject invention.

Referring now to FIG. 1, the embodiment of the invention is shown comprising V-shaped support arms 11 and 12 which rest upon the ground or the grass of a football field. Support arms 11 and 12 nominally are of equal length and are joined at their apex 13, at which point is joined additional support arm 14. All three arms, 11, 12, and 14 are planar and make contact with the ground.

Support arms 11 and 12 may be anchored to the ground by rods 20 driven into the ground and attached to arms 11 and 12, or the support may be free-sliding as desired. While the preferred embodiment shows the angle between arms 11 and 12 as being 150°, this angle may be changed during its construction to suit whatever age group the device may be utilized by, for example, younger children may wish a more acute angle so that successive simulated offensive player's helmets may be closer together. Support arms 11, 12, and 14 are constructed of heavy gauge large diameter steel pipe, such as a standard size of 3 to 7 inch diameter pipe.

Attached to support arms 11 and 12 are a plurality of upright standards 15, to which are attached spring supports pipe 16 at an angle of approximately 120°. Connected to the end of spring support pipes 16 is spring 17, the other ends of which is attached to a helmet support pipes 18, which in turn attaches to football helmets 19 by means of plates 25 (shown in dotted lines). Upright standards 15 is usually welded to its respective support arms 11 or 12, and spring support pipes 16 is welded to upright standards 15. Connection of spring 17 to spring support pipe 16 and helmet support pipe 18 is shown in FIG. 3, as in the method of attachment of helmet support pipe 18 to helmet 19 by means of helmet plate 25 in FIG. 3A.

Figure 2:
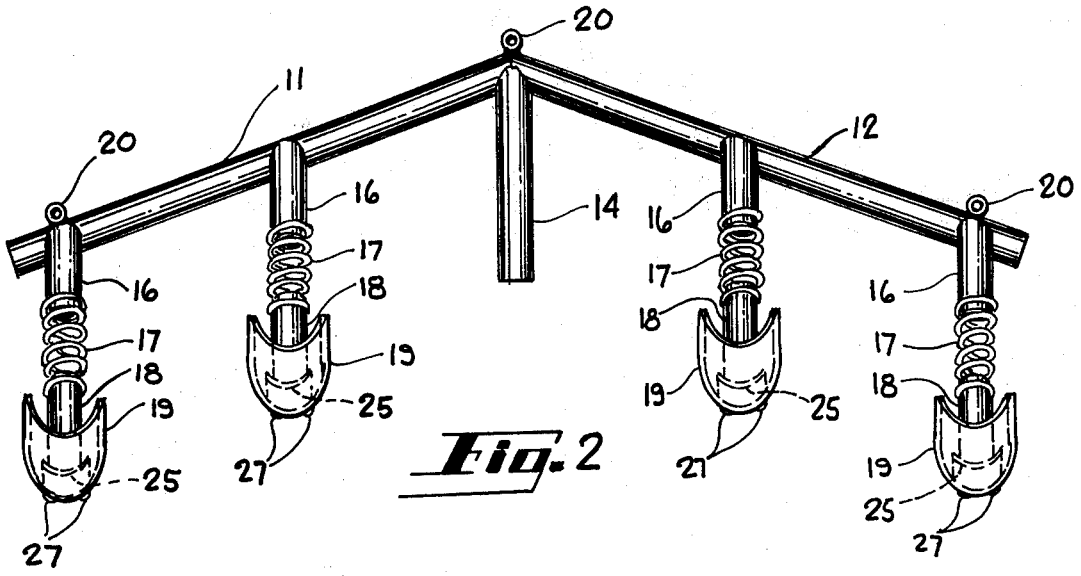
FIG. 2 is a top view of the subject invention.

FIG. 2 is a top-view of the inventive football training device showing support arms 11, 12, and 14. Also shown are eye bolts 20 which are attached to support arms 11 and 12 at their ends and junction, and through whose eye steel rod 20*a* (FIG. 1) is driven into the ground to make stationary the invention. Shown in the top view are pipe spring supports 16 which joins upright standards 15 (not shown) and to which springs 17 are operably connected. At the opposite end of springs 17 are pipe helmet supports 18 which extends interiorly to helmets 19 and is welded to helmet plate 25. Helmets 19 then are attached to helmet plates 25 by means of bolts 27 extending through helmets 19 to matching holes in the helmet plates 25.

As can be seen from FIG. 2, the 150° angle between support arms 11 and 12 is clearly fixed as is the spacing between the helmets.

Figure 3:
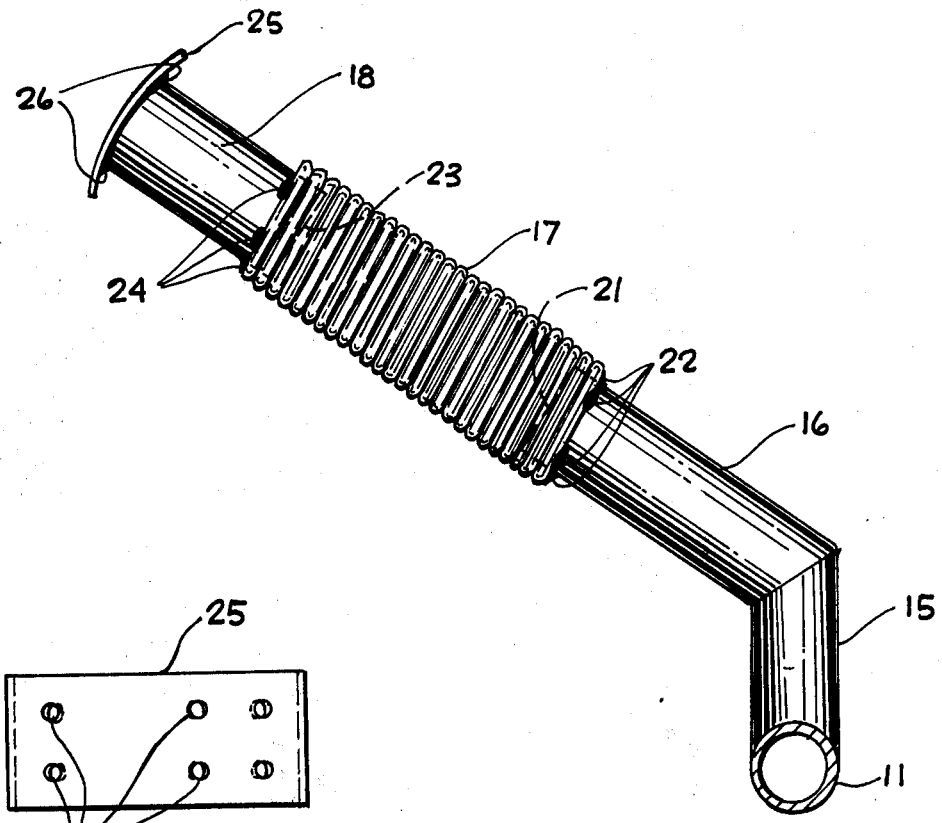
FIG. 3 is a side view of the upright standard, spring assembly and helmet attachment.

FIG. 3 is a side view of the structural members that support the helmets, taken from the left side. Shown in FIG. 3 is a cross section of support arm 11 at its intersection with upright standard pipe 15. Pipe 15 is welded to support 11 and is cut at a 30° angle to which is welded pipe spring support 16, which also is cut at a 30° angle. Together, upright standard pipe 15 and pipe 16 form a 120° angle. Spring 17 encompasses the end 21 of pipe spring support 16 and is attached thereto by spot welds 22, located around the periphery of spring 17. Nestled inside of the other end of spring 17 distal from the end encompassing pipe 16 is helmet support pipe 18. As shown in FIG. 3, end 23 of helmet support pipe 18 inserts into spring 17. Spring 17 is attached to pipe 18 by spot welds 24. At the end of pipe 18 distal to spring 17 is helmet plate 25, which is rectangular in shape and which is arcuate shaped to interface with the inside of helmet 19. Bolts 27 (not shown) extend through helmet 19 to fasten to plate 25. Rectangular plate 25 is attached to pipe 18 by spot welds 26. Spring 17 is a stiff tension steel spring of the type commonly available. However, compression springs of the type used in automobile suspension systems may also be used. FIGS. 1 and 2 show the compression springs while FIG. 3 shows the tension type spring.

Figure 3A:
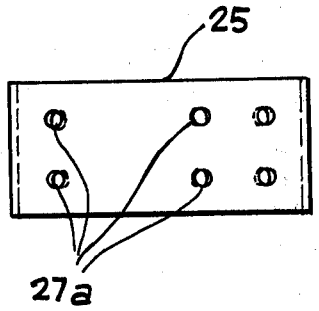
FIG. 3A is a schematic diagram of the helmet attachment plate.

FIG. 3A is the top view of helmet plate 25, showing the location of mounting holes 27*a* which mate with bolt means 27 interior to helmet 19 (not shown) in order to hold the helmets in place.

Figure 4:
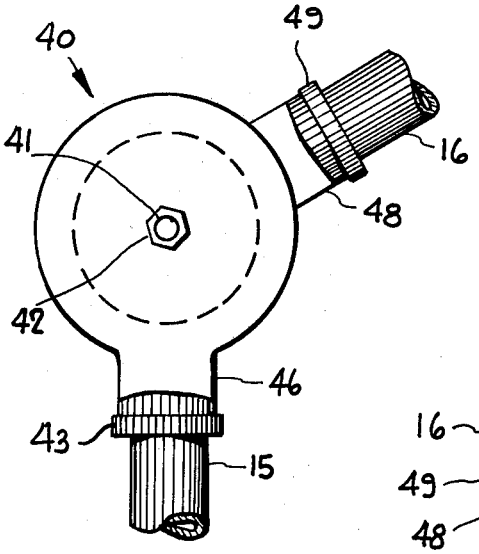
FIG. 4 is a side view of the clutch assembly for the rotatable arm.
Figure 5:
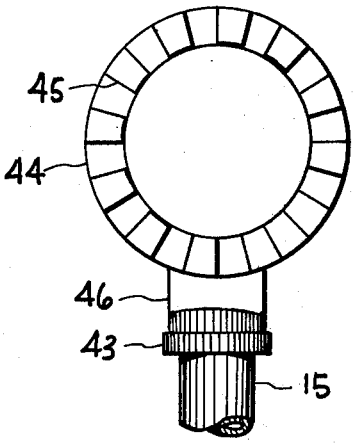
FIG. 5 is a side view of the circular plate with teeth of the rotatable arm section shown in FIG. 4
Figure 6:
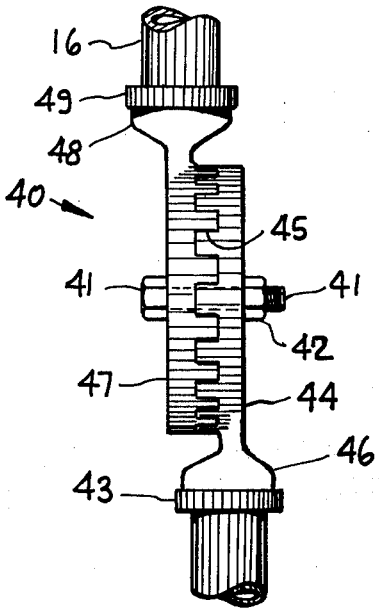
FIG. 6 is a front view of the assembled clutch showing the engaging teeth of the rotatable arm.

Inasmuch as it is a desirable feature that the inventive football training device have means for adjusting the height of the helmet above the ground in order to facilitate different age groups of player participants, FIG. 4 shows an alternate embodiment of the structural members of the invention which contribute to position the helmets' height. To this end, the normally welded connection between upright standard 15 and spring support box 70, pipe 16 is changed in order to adjust the height of helmet 19. As seen in FIG. 4, clutch assembly 40 comprising two circular plate sections having engaging alternate teeth with a center bolt 41 and nut 42 holding the sections in nesting engaging arrangement is utilized. Attached to upright standard 15 is a pipe cap 43 to which is attached the first half of the circular plate 44 upon which radial teeth 45 have been cut (FIG. 5). Shaft 46 connects pipe cap 43 to circular plate 44. The second half of the clutch, plate 47 which similarly has alternate engaging teeth, attaches at its periphery to shaft 48 which joins pipe cap 49 which in turn connects to spring support pipe 16. As can be seen from FIGS. 4–6, each half of the circular, radial toothed clutch may be separated by loosening nut 42 on bolt 41, sliding the clutch plates apart, rotating one plate relative to the other, re-engaging the clutch plate teeth at a new point, and then tightening nut 42 on bolt 41 to hold the clutch together. The clutch assembly, the connecting shafts, and the pipe caps are preferably made of steel in order to have the strength necessary to resist pounding by the football players when utilizing the invention.

Figure 7:
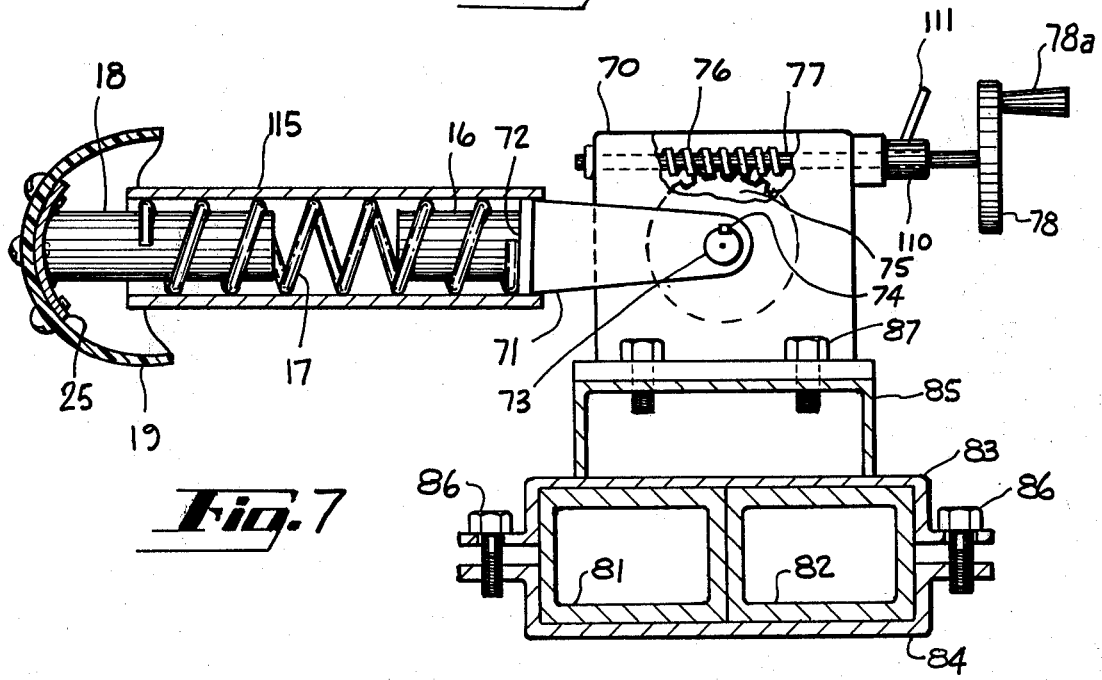
FIG. 7 is an alternate embodiment showing the worm gear assembly for the rotating arm.

The second embodiment comprising means to adjust the height of the helmet above the ground is shown in FIG. 7 where a worm gear and a co-operating worm is used to raise and lower the helmet.

The main advantage shown in the design represented on FIG. 7 resides in the fact that the coach can change the height of each helmet within seconds. The distance from the lowest position of the helmet to the highest position makes this design of the subject invention suitable for training of players from junior high through senior high school and college.

Reference is now made to FIG. 7. The design shown differs from the previous design in the employment of a single reduction worm gear drive having a suggested reduction ratio of 1:60 and tubular metal support arms. With this reduction, it would take 15 revolutions of handwheel 78 to move the helmet from the horizontal position to the vertical position. Shown in FIG. 7 is lever arm 71 which is attached to worm gear 75 by means of shaft 73 with key 74. Shown in nesting arrangement with worm gear 75 is worm 76 attached to shaft 77 which extends through both sides of gear housing box 70 having handle 78 on one end with clutch 110 having handle 111 attached thereto. Attached to lever arm 71 is pipe 16 which is in welded relationship to spring 17 hereinbefore discussed. Similarly, at the opposite end of the spring 17 is helmet support pipe 18 which in turn attaches to helmet plate 25 bolted to helmet 19. Shown in FIG. 7 is sleeve 115 which is made of a flexible covering material, such as rubber, and installed over spring 17 to protect the players if they should make contact with the portion of the apparatus beneath the helmet.

When the coach or other party operating the invention desires to change the position of the helmet, he turns handle 111 of clutch 110 to release shaft 77 and then turns handwheel 78 until he has adjusted the helmet at its new desired position. As soon as this is accomplished, the clutch 110 is tightened against gear housing box 170 by turning handle 111 to lock the worm gear 176 which in turn locks lever arm 71.

Continuing on with FIG. 7, means are shown by which the relative placement position of the helmets may be adjusted. Adjustment means shown in FIG. 7 are such that the upright standard, rather than being welded the support arms 11 and 12, is welded to two U-shaped structural sections bolted together at opposite ends to encompass the support arm. As shown in FIG. 7, the support arms comprise two square or rectangular cross-section steel members 81 and 82 touching each other and welded together at their common side. The two U-shaped members 83 and 84, are held together to clamp the rectangular cross section members 81 and 82 by means of threaded bolts 86 on either side of U-shaped members 83 and 84. To the top surface of U-shaped member 83 is welded upright standard 85, to which is attached the gear housing box 70 by means of threaded bolts 87. To adjust the position of the helmets relative to one another, all one need do is loosen threaded bolts 86 and slideably adjust the U-shaped structural members 83 and 84 along rectangular structural members 81 and 82 until the desired helmet position is achieved.

Figure 8:
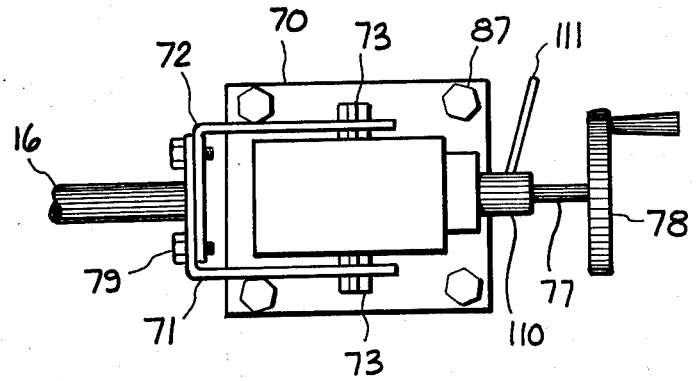
FIG. 8 is a cross-section view of the connector assembly for adjusting the position of the helmets along the V-shaped support.

FIG. 8 is a top-view of the alternate embodiment lever arm 71 and its mate 72, each of which attach to opposite sides of shaft 73 connected to worm gear 75 (not shown). The top of securing bolts 87 are shown on the base plate of gear reduction box 70. Also shown in FIG. 8 is clutch 110, its operating handle 111, shaft 77 attached to worm gear 76 (not shown) interior to gear housing box 70, and handwheel 78. Shown in FIG. 8 is the method of connection between L-shaped lever arms 71 and 72, namely bolt means 79 through their leg portions of the L-shape. Weldably attached to lever arm 72 is pipe means 16, a portion of which is shown.

Figure 9:
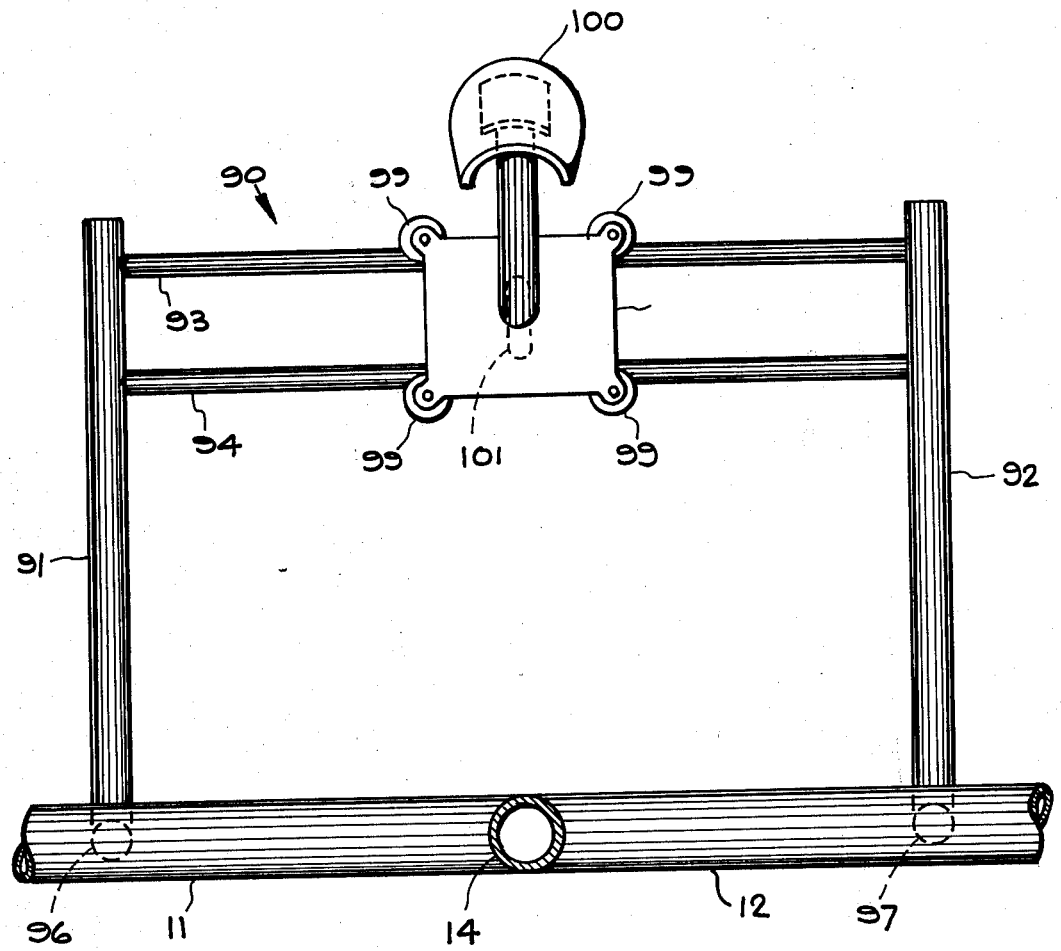
FIG. 9 is a front view of the direction indicating trolley assembly.

FIG. 9 shows the front view of the player direction indicator 90 which attaches to the support arms 11 and 12 and positioned behind the apex of support arms 11 and 12, i.e., on the opposite side of support arms 11 and 12 as the defensive player. As shown in FIG. 9, the front view of the direction indicator 90, vertical supports 91 and 92 rise up from their welded attachment to support arms 11 and 12 respectively to meet with parallel cross members 93 and 94 which connect to the vertical supports 91 and 92. Vertical supports 91 and 92 are bent into an L-shape with the shortest portion of the L Section extending to and welded on to support arms 11 and 12 proximate center support arm 14. The joining of vertical supports 91 and 92 to support arms 11 and 12 are shown at 96 and 97 which showed by dashed lines the end section of 91 and 92. The lower and shorter portion of L-shaped vertical supports, which parallels the ground level and whose ends are attached to support arms 11 and 12, serve to extend the direction indicator device away from the apex of the V-shaped support arms. This way, the coach standing behind the directional indicator 90 will not be stepping upon the apex of the support arms 11 and 12. The vertical supports 91 and 92 rise from the ground level to a level of waist height.

Trolley 98 has wheels 99 which roll upon cross members 93 and 94 permitting trolley 98 to move along the cross members to either end of the vertical supports 91 and 92. Helmet 100, usually brightly colored, is attached to trolley 98 and is the visual indication that defensive football player participants watches for movement to indicate to him when to proceed to engage the helmets on the invention in the rip-up movement and which direction, either left or right, to initiate his rip-up movements. As can be seen from FIG. 1 and FIG. 2 the defensive player, from his centrally located position, engages the helmet on the indicated side nearest him and then must move slightly backward to engage the next helmet in line. Handhold 101, shown in FIG. 9, is grasped by the coach who stands behind the direction indicator 90 and by moving the trolley left or right, starts the defensive player on his practice exercise.

After the coach has indicated to a defensive player when to begin his rip-up operation and in which direction, the coach returns the trolley to a center position between the vertical supports and the direction indicating device is ready for the next player to take his position.

While a preferred embodiment has been shown and described, it will be understood that there is no intent to limit the invention by such disclosure, rather, it is intended to cover all modification in alternate construction falling within the spirit and scope of the invention as defined in the appended claims.

I claim:

1. A football training device for training defensive football players in the blocking rip-up movement comprising V-shaped structure ground standard means, a plurality of upright structural means attached to each side of said V-shaped ground standard means in defined spaced apart relationship, spring means connecting to said upright structural means distal said ground standard means, and helmet means connecting said spring means distal said upright structural means whereby a defensive football player centrally located in said V-shaped structure may block aside said helmet means on one side and continue on to block said other helmet means behind him in one continuous motion.

2. The football training device defined in claim 1 wherein said spring connection means upright structural means is angled from the vertical.

3. The football training device defined in claim 1 wherein said spring connection means upright structural means comprises clutch assembly means wherein said clutch assembly may be separated, the angle of said structural means attached to said spring means first end may be rotatably adjusted, and said clutch assembly brought together whereby the height of the helmet means above the ground standard may be adjusted.

4. The football training device defined in claim 1 wherein said upright standard means comprises worm and worm gear means, said worm gear attached to said second structural means connected to said spring means first end and said worm operably attached to said upright structural means whereby said second structural means attached to said spring means may be adjustably rotated to adjust the height of the helmet above the ground standard.

5. A football training device as defined in claim 1 wherein said ground standard means V-shaped structural means comprises pipe means and said upright structural means is pipe means welded to said ground standard means.

6. The football training device defined in claim 1 wherein said upright structural means comprises clamp means operably attached to said ground standard means V-shaped structural means wherein said clamp means may be loosened and said upright structural means may be adjusted along the length of said ground standard means.

7. The football training device defined in claim 1 wherein direction indicator means are operably attached to said ground standard means, said direction indicator means comprising movable trolley means with indication means thereon whereby a person may indicate by means of the trolley means which direction a football player may block.

* * * * *